US006708617B2

(12) United States Patent
Corrado et al.

(10) Patent No.: US 6,708,617 B2
(45) Date of Patent: Mar. 23, 2004

(54) TRAVERSING CONTACT CLEANING ROLLER SYSTEM

(76) Inventors: Frank C. Corrado, 33 Gateway Rd., Rochester, NY (US) 14624; James W. Fischer, 118 Bellehurst Dr., Rochester, NY (US) 14617; Gary R. Larsen, 726 Eastwood Cir., Webster, NY (US) 14580; Ronald W. Sweet, 5560 E. Lake Rd., Conesus, NY (US) 14435

( * ) Notice: Subject to any disclaimer, the term of this patent is extended or adjusted under 35 U.S.C. 154(b) by 148 days.

(21) Appl. No.: 10/115,199

(22) Filed: Apr. 2, 2002

(65) Prior Publication Data

US 2002/0152909 A1 Oct. 24, 2002

Related U.S. Application Data

(63) Continuation-in-part of application No. 09/579,645, filed on May 26, 2000, now Pat. No. 6,568,326, which is a continuation-in-part of application No. 09/294,952, filed on Apr. 20, 1999, now Pat. No. 6,196,128.

(51) Int. Cl.[7] ..... B41C 1/00
(52) U.S. Cl. ..... 101/483; 101/425
(58) Field of Search ..... 101/483, 423, 101/424, 425; 15/256.5, 256.51, 256.52, 256.53; 134/6, 9; 399/34

(56) References Cited

U.S. PATENT DOCUMENTS 3,999,239 A * 12/1976 Misuna ..... 15/88
4,019,217 A * 4/1977 Schinke ..... 15/256.53
4,558,480 A * 12/1985 Okafuji et al. ..... 15/77
5,739,695 A * 4/1998 Zerod et al. ..... 324/637
5,989,358 A * 11/1999 Korbonski ..... 134/9
6,261,378 B1 * 7/2001 Hashimoto et al. ..... 134/6

* cited by examiner

*Primary Examiner*—Anthony H. Nguyen
(74) *Attorney, Agent, or Firm*—Robert C. Brown

(57) ABSTRACT

A system for cleaning a moving substrate includes a rail mounted adjacent to the substrate surface and substantially transverse to the direction of movement thereof. A carriage for supporting a contact cleaning roller (CCR) is deployed on the rail for allowing axial translation of the CCR transversely of the substrate while in rolling contact therewith. Two renewal stations for cleaning the CCR are mounted adjacent the rail, one outboard of each substrate edge. The CCR is at least twice as long as the width of the substrate and is axially oscillable for a distance sufficient that all portions of the CCR surface may be cleaned by the renewal stations during one oscillation cycle of the CCR while the CCR maintains continuous contact with the substrate across the full width thereof. The CCR mounted on the carriage may be a primary CCR and the substrate may be a continuous web or sheet, or the CCR mounted on the carriage may be a secondary CCR and the substrate may be a primary CCR or other process roller.

10 Claims, 5 Drawing Sheets

TRAVERSING CONTACT CLEANING ROLLER SYSTEM

This application is a Continuation-in-Part of our pending application Ser. No. 09/579,645, filed May 26, 2000 now U.S. Pat. No. 6,568,326, which is a Continuation-in-Part of our application, Ser. No. 09/294,952, filed Apr. 20, 1999, now matured as U.S. Pat. No. 6,196,128, issued Mar. 6, 2001.

The present invention relates to methods and apparatus for cleaning particulate contamination from a moving substrate surface; more particularly, to methods and apparatus for traversing a contact cleaning roller axially while rolling along a moving substrate to transfer contaminant particles from the moving substrate to the contact cleaning roller; and most particularly, to methods and apparatus for progressively and continuously cleaning a contact cleaning roller while the roller itself is continuously cleaning a moving substrate.

In many manufacturing processes involving substrates, for example, in continuous-web printing and in the coating of photographic films and papers, particulate contamination of the substrate surface can lead to reduced to quality of the coated product and to increased waste. It is known to use a polymer-covered roller in rolling contact with a planar substrate to remove particles from the surface of the planar substrate ahead of the printing or coating point. It is also known to use a polymer-covered roller in rolling contact with another roller, for example, a process roller such as another contact cleaning roller, calendar roller, offset printing roller, and the like. The surface of such a polymer-covered roller (known in the art as a contact cleaning roller and also referred to herein as a CCR), may comprise a polymer having a high surface energy, for example, polyurethane or silicone rubber, or alternatively, a polymer exhibiting adhesive tack, such as any of the well-known tape adhesives. The CCR surface exhibits a greater attraction for particles than does the substrate surface, so that particles are transferred from the substrate to the CCR at the point of rolling contact.

A CCR may itself function as a conveyance roller, for example, in a string of web conveyance rollers, in which use the CCR may enjoy a substantial angle of wrap of the web, for example, a wrap angle of 90° or even greater. A conveyance roller as used herein is a roller whose position defines a portion of a web conveyance path. Such engagement by a CCR may be on either side of the web being conveyed. See, for example, U.S. Pat. No. 5,251,348 issued Oct. 12, 1993 to Corrado et al. A CCR may also function as a non-conveyance roller, that is, the web conveyance path is not a function of the presence or absence of the CCR. In such use, a CCR typically is positioned as a nip roller urged against a non-CCR conveyance roller (backing roller), the web passing therebetween, whereby the web is conveyed on a first or back side against the conveyance roller and is cleaned on a second or front side by the CCR. See, for example, U.S. Pat. No. 5,611,281 ('281) issued Mar. 18, 1997 to Corrado et al. which is hereby incorporated by reference.

Many substrates, for example, web substrates, have particulate contamination concentrated along the outer edges of the substrate surface which can lead to premature clogging and failure of a full-width CCR while more central portions of the CCR surface are still non-clogged and serviceable. The U.S. Pat. No. 5,611,281 patent discloses to prolong the useful life of a CCR between renewals (removal of accumulated particles) by oscillating the CCR axially a short distance by transverse translating means while it is rolling along the substrate surface; thereby causing accumulating particles to be distributed as a broad band over a substantial portion of the axial length of the roller along each substrate edge.

Through use, the surface of a CCR becomes progressively clogged with removed particles and progressively loses cleaning effectiveness. Cleaning, also known as renewal, of a CCR surface may be accomplished through washing, for example, as disclosed in U.S. Pat. Nos. 5,275,104 and 5,611,281, the latter of which being incorporated herein by reference, wherein a plurality of CCR's are alterably provided such that continuous cleaning of the substrate surface can be maintained by a fresh CCR while each CCR in turn is rotated out of service for offline renewal, including drying. This is necessary in the prior art because washing of a CCR while in service against a substrate risks undesirable transfer of cleaning fluid onto the substrate. Such a multiple-CCR installation is complex and costly to build and to maintain.

Alternatively, as disclosed in the '281 patent, a higher-tack, or secondary, CCR may be engaged to clean particles from a lower-tack, or primary, CCR (which procedure is defined hereby as secondary cleaning) which itself has cleaned, or is actively cleaning, particles from some other substrate surface such as a web or another process roller (which procedure is defined hereby as primary cleaning) For continuous primary cleaning, this arrangement requires continuous contact of the primary CCR with the substrate. Thus, a problem arises as to how to clean or renew the secondary CCR without reverse-contaminating the primary CCR and, indirectly, the substrate being cleaned Typically, a secondary CCR, like a primary CCR, comprises a solid polymer covered roller or a length of adhesive tape wound on a core with the adhesive surface facing outwards In the prior art, renewal of the secondary CCR requires first that the roller be retracted from contact with the primary CCR to avoid contamination thereof and replaced in its cleaning function by another secondary CCR A secondary CCR may then be washed automatically offline, as referenced above, or manually by an operator, either in place or after being removed to a washing station. A tape-type secondary CCR is renewed either by unwinding and discarding the exposed tape to present a fresh convolution or by replacing the roll of tape when spent, as disclosed in U.S. Pat. No. 4,009,047. In such a prior art application, at least two alternable secondary CCR's are required, at an increase in expense and complexity Thus there is a need for a method and apparatus for providing online renewal cleaning of a CCR, either primary or secondary, which permits regular renewal of the CCR without requiring any additional or replacement CCR's and without endangering the substrate being cleaned.

It is a principal object of the invention to provide an improved method and apparatus for safe, inexpensive, simple, and frequent renewal of a primary and/or secondary CCR while performing its online cleaning function.

It is a further object of the invention to provide an improved method and apparatus for continuous cleaning of a substrate by a single CCR.

Briefly described, a system for cleaning a moving substrate includes a contact cleaning roller mounted on translating means for axially oscillating the CCR, an example of such translating means being a carriage on a rail mounted adjacent to the substrate surface and substantially transverse to the direction of movement thereof, the roller being in rolling contact with the substrate surface, substantially as disclosed in Patent '281. First and second renewal stations for cleaning the CCR are fixedly mounted adjacent the rail, one being so disposed outboard of each longitudinal edge of the substrate. The CCR is at least twice as long as the width of the substrate and therefore is in renewal contact with at least one of the renewal stations at all times. The CCR is axially oscillable for a distance sufficient that all portions of the CCR surface are cleaned by the first and second renewal stations in combination during one oscillation cycle of the CCR while the CCR maintains continuous contact across the full width of the substrate. Viewed in plan view, the left renewal station cleans the entire left half of the CCR during that portion of the oscillation cycle wherein the CCR extends beyond the left edge of the substrate, and the right renewal station cleans the entire right half of the CCR during that portion of the oscillation cycle wherein the CCR extends beyond the right edge of the substrate. In a preferred method, the cleaning station is engaged with the CCR for renewal during the outward stoke of the CCR past the station and is retracted during the inward stroke, although the station may also be left in contact with the CCR during the inward stroke if so desired. Generally, this is not necessary.

Thus, a single CCR may be continuously cleaned without being pivoted out of contact with the substrate and without risk of contamination to the substrate as in the prior art.

In a first preferred embodiment, a contact cleaning roller mounted on the carriage is a primary CCR and the substrate is an object such as a continuous flexible web or rigid sheet to be cleaned by the apparatus and method of the system.

In a second preferred embodiment, a contact cleaning roller mounted on the carriage is a secondary CCR and the substrate is a primary CCR for cleaning an object such as a web. The primary CCR is positionable to be in contact with a surface of a substrate to be cleaned and may also be positionable to be out of contact with the substrate surface as desired. The primary CCR preferably is axially fixed and in length is of the order of the width of the substrate. The secondary CCR may be moved axially along the surface of the primary CCR either in contact or out of contact therewith.

Two substantially identical CCR cleaning systems in accordance with the invention may be disposed on opposite sides of a substrate to clean both sides in a single pass of the substrate through the apparatus.

The foregoing and other objects, features, and advantages of the invention, as well as presently preferred embodiments thereof, will become more apparent from a reading of the following description in connection with the accompanying drawings in which.

Figure 1:
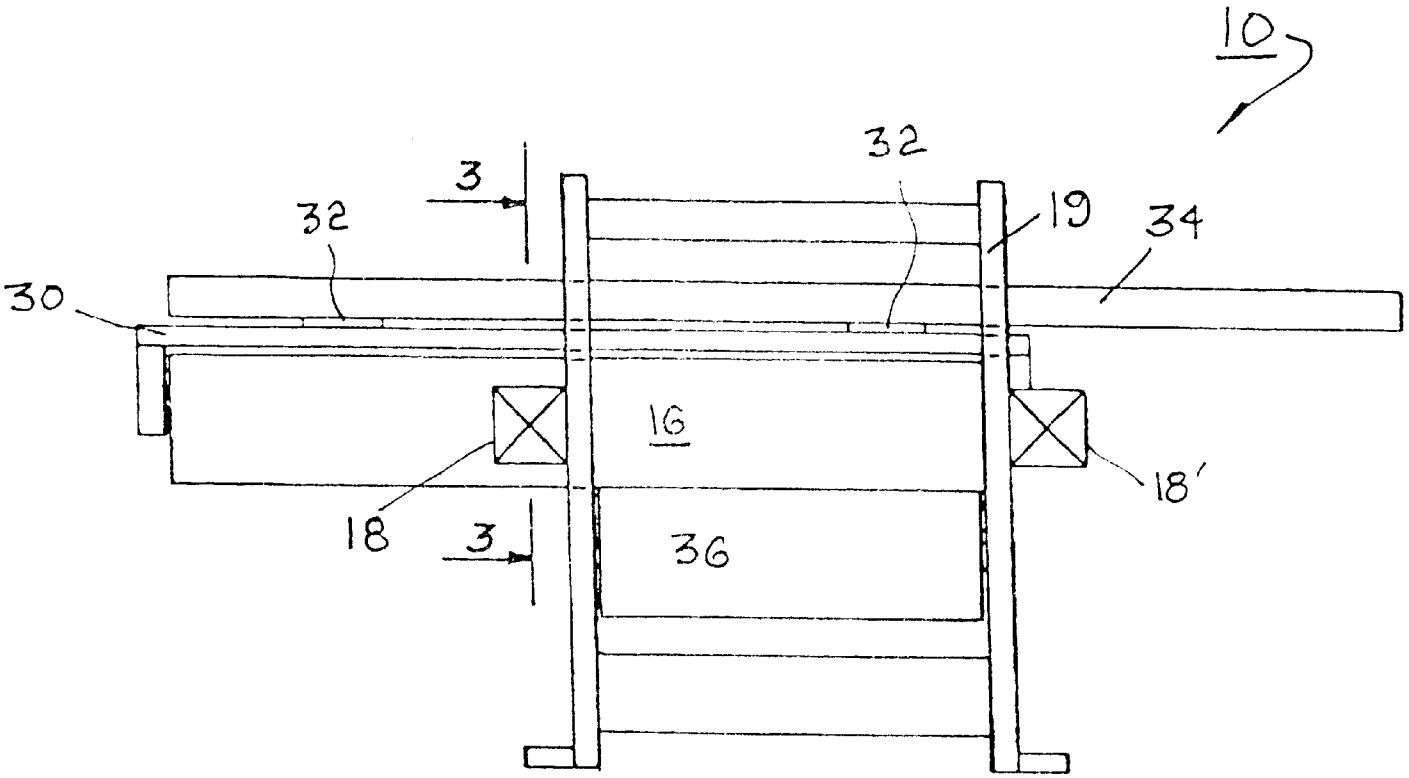
FIG. 1 is a front elevational view of a first embodiment of an axially oscillable CCR system for cleaning a substrate in accordance with the invention.
Figure 3:
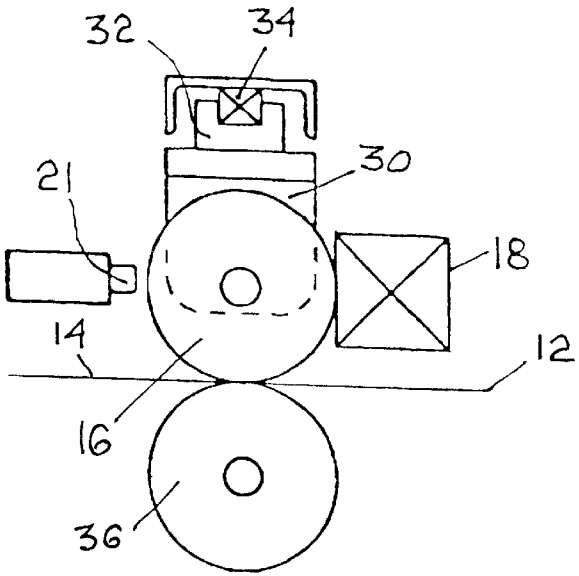
FIG. 3 is a schematic cross-sectional view of the CCR system shown in FIG. 1 taken along line 3—3, showing the primary CCR in nipped relationship with a backing roller for cleaning a surface of a substrate passing therebetween.
Figure 2:
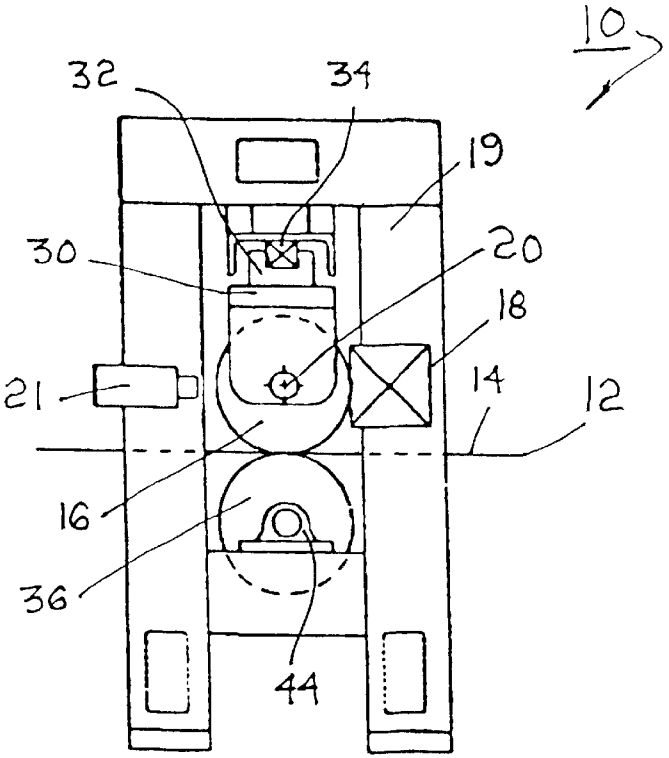
FIG. 2 is a side elevational view of the system shown in FIG. 1.

The invention is defined by the claims. Apparatus and methods in accordance therewith are useful in processes for cleaning flexible substrates comprising, but not limited to, plastic, metal, and paper webs and sheets, and rigid planar substrates comprising, but not limited to, circuit boards and silicon wafers. Process rollers such as other contact cleaning rollers, printing rollers, conveyance rollers, coating backing rollers, and calendar rollers are also cleanable substrates within the scope of the invention.

Referring to FIGS. 1 through 6, there is shown a first embodiment of a CCR system 10 in accordance with the invention for continuous cleaning of a substrate 12 having a first surface 14 by means of continuous rolling contact with a contact cleaning roller 16, and for continuous renewal of the contact cleaning roller 16 by continuous contact with at least one renewal station 18, 18'.

Substrate 12 is moving in the direction 13 shown, and CCR 16 is mounted for rotation about an axis 20 disposed substantially orthogonal to direction 13. Substrate 12 is of indefinite length and has first and second longitudinal edges 22, 22' and a surface width 24 therebetween. CCR 16 has a length 26 of roller surface 28 which is at least twice width 24.

Renewal stations 18, 18' are mounted to machine frame 19 adjacent and outboard of edges 22, 22' such that CCR 16 is in cleaning contact with at least one of stations 18, 18' at all times while CCR 16 is cleaning surface 14 Renewal stations 18, 18' are preferably identical and may be fashioned conventionally, for example, as disclosed as "cleaner 52" (except for the traversing mechanism in Patent '281. Stations 18, 18' preferably may be mounted conventionally for retraction from contact with the CCR as desired, for example, during the inward stroke of the renewed CCR back onto the substrate, or for maintenance of the stations in known fashion Preferably, each renewal station is provided with an associated drying nozzle 21 supplied with air from a clean air supply (not shown) for evaporating cleaning fluid which may be residual on the surface of the CCR after renewal, to prevent tracking of such fluid onto the substrate surface being cleaned.

For translation across the web, CCR 16 is rotatably supported at the ends thereof in carriage 30 which in turn is translatably suspended by hangers 32 from rail 34 mounted on frame 19. Carriage 30 and CCR 16 may be driven reciprocably along rail 34, for example, by such known translating means as are fully discussed and illustrated in incorporated reference Patent '281.

In first embodiment 10, CCR 16 is disposed in nipped relationship with a backing roller 36 to urge substrate 12 against CCR 16 as the substrate is passed between the CCR and the backing roller.

Figure 4:
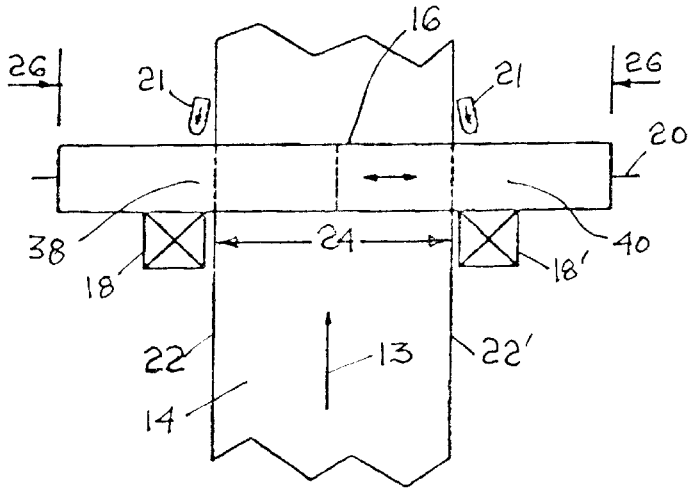
FIG. 4 is a plan schematic view of the system shown in FIG. 1, showing the CCR at the midpoint of an oscillation cycle.
Figure 5:
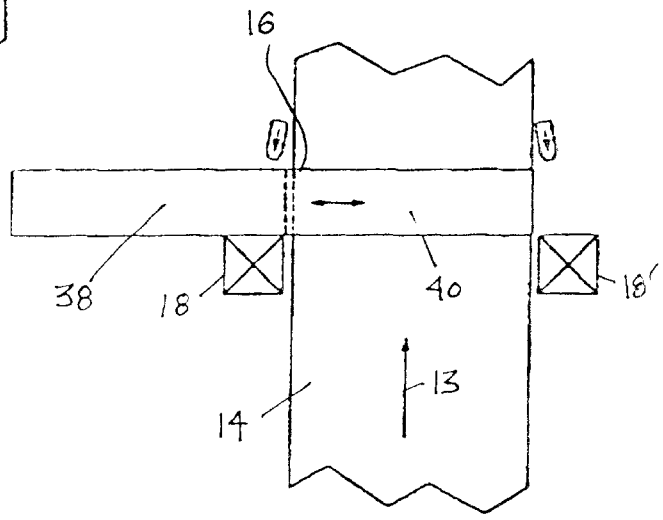
FIG. 5 is a view like FIG. 4, showing the CCR at a first travel extreme in an oscillation cycle.
Figure 6:
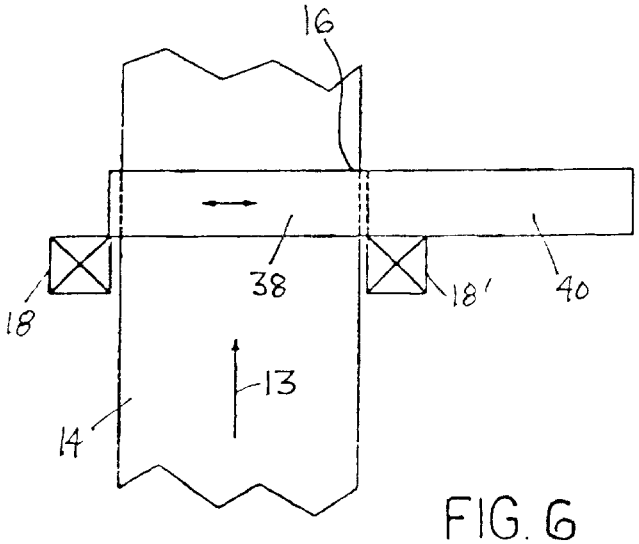
FIG. 6 is a schematic view like FIG. 4, showing the CCR at a second travel extreme opposite to that shown in FIG. 5.
Figure 8:
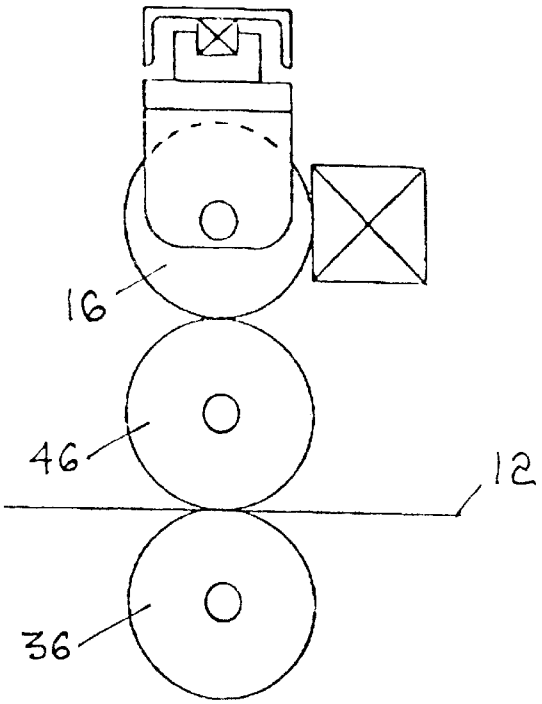
FIG. 8 is a schematic cross-sectional view of the CCR system shown in FIG. 7, showing the primary CCR in nipped relationship with a backing roller for cleaning a surface of a substrate passing therebetween, and an oscillable secondary CCR cleaning the primary CCR.
Figure 7:
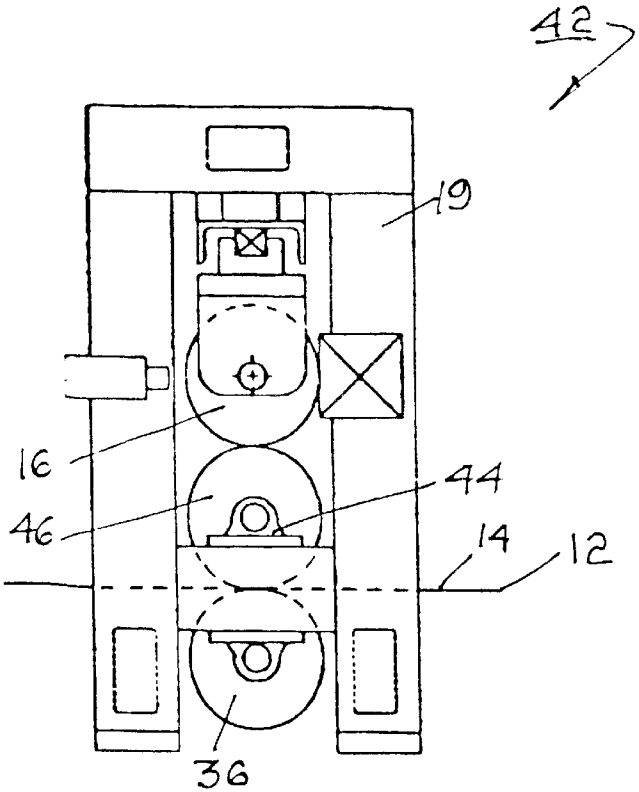
FIG. 7 is a side elevational view of a second embodiment in accordance with the invention, showing a CCR positioned for cleaning a process roller, which roller may be a primary CCR.
Figure 10:
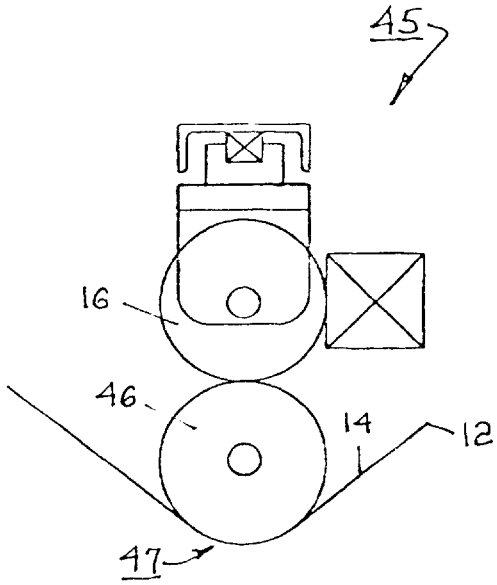
FIG. 10 is a view similar to the view shown in FIG. 8 but wherein the primary CCR is a conveyance roller engaged on a free span of the substrate.

In operation, CCR 16, being in rolling, cleaning contact with surface 14 across the entire width of the surface and also in renewal contact with renewal stations 18, 18', as shown in FIG. 4, is progressively translated in a first direction, which is to the left in FIG. 4 such that eventually the entire left half 38 of CCR 16 is renewed by station 18 (and the outer portion of right half 40 by station 18') while surface 14 is still being cleaned. At the travel extreme shown in FIG. 5, left half 38 is fully renewed and the surface is being cleaned solely by right half 40. The carriage direction is reversed and the cleanings are repeated in reverse, until the entire right half is cleaned by station 18', the opposite travel extreme shown in FIG. 6 is reached, and the surface is being cleaned solely by left half 38. The carriage direction is then reversed to return the CCR to the starting position shown in FIG. 4, completing one oscillation of the apparatus. In this way, a single CCR may be renewed regularly, reliably, automatically, and online while simultaneously cleaning continuously a moving substrate surface Some substrates, such as very thin webs or fragile sheets, can be wrinkled, distorted, or otherwise damaged by oscillation of a CCR. As shown in a second embodiment 42 in FIGS. 7 and 8, a primary CCR 46 can be mounted in fixed bearings 44 in place of backing roller 36 in embodiment 10, and CCR 16 becomes therefore a secondary CCR as defined above Backing roller 36 may be relocated to a new nipped relationship with CCR 46. System 42 thus affords the regular CCR renewal benefits of system 10 without axial oscillation of the primary CCR against the substrate, at a cost of one additional CCR. Alternatively, as shown in a third embodiment 45 in FIG. 10, primary CCR 46 may be a substrate conveyance roller disposed on a free span 47 of the substrate 12 without a backing roller.

Figure 9:
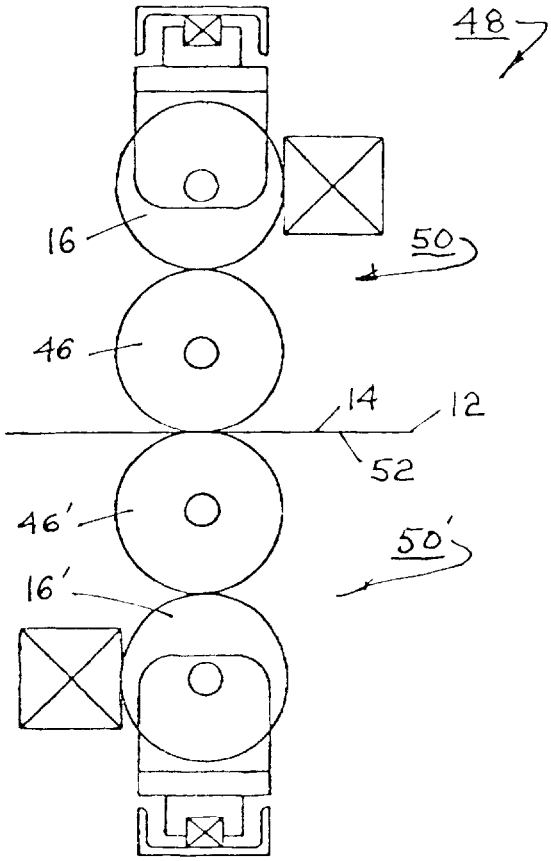
FIG. 9 is a schematic cross-sectional view of a multiple system of CCR's like that shown in FIG. 8, disposed for cleaning opposite surfaces of a substrate simultaneously.

In some applications, as shown in a fourth embodiment 48 in FIG. 9, it may be desirable to have two substantially identical individual CCR systems 50, 50' similar to system 42 and having analogous components mounted in opposition, substrate 12 passing in nipped relationship therebetween, such that first substrate surface 14 and second substrate surface 52 may be cleaned simultaneously.

From the foregoing description, it will be apparent that there has been provided an improved method and apparatus for cleaning particles from a moving substrate, wherein a contact cleaning roller at least twice as long as the width of the substrate is translated axially of itself and transversely of the substrate while in rolling contact with a surface of the substrate for cleaning particles therefrom, and wherein cleaning stations outside each edge of the substrate continuously renew portions of the CCR surface not in such rolling contact. Variations and modifications of the herein described improved method and apparatus, in accordance with the invention, will undoubtedly suggest themselves to those skilled in this art. Accordingly, the foregoing description should be taken as illustrative and not in a limiting sense.

What is claimed is:

1. A system for cleaning particles from a first surface of a substrate moving along a conveyance path in a first direction, the substrate having a width transverse to the first direction and having first and second longitudinal edges parallel to said first direction, comprising:

a frame adjacent to the substrate;

b) translating means mounted on said frame and operative in a second direction transverse to said first direction;

c) a contact cleaning roller having an outer surface contactable with said substrate surface mounted on said translating means for axial motion in said second direction while in rolling contact with said substrate surface in said first direction, said contact cleaning roller having a length at least twice the substrate width such that a total portion of said contact cleaning roller equal in length to at least one half of the axial length thereof is outside of said first and second edges of said substrate at all times; and d) first and second renewal stations for renewing said outer surface of said contact cleaning roller stationarily mounted on said frame outboard of the conveyance path adjacent the first and second substrate edges, respectively, and disposable into renewal contact with said total portion of said contact cleaning roller outside of said first and second edges.

2. A system in accordance with claim 1 wherein said axial motion in said second direction is oscillatory.

3. A system in accordance with claim 2 wherein the extent of said axial oscillation is sufficient that at least one half of said contact cleaning roller is renewed by each of said first and second renewal stations during one cycle of said oscillation.

4. A system in accordance with claim 1 wherein said translating means includes a rail mounted on said frame and a carriage slidably mounted on said rail for receiving said contact cleaning roller.

5. A system in accordance with claim 1 wherein at least one of said renewal stations is retractable from contact with said contact cleaning roller.

6. A system in accordance with claim 1 wherein said contact cleaning roller is retractable from contact with said substrate.

7. A system in accordance with claim 1 wherein said substrate is selected from the group consisting of flexible web formed of plastic, metal, paper, and combinations thereof, rigid planar substrate, contact cleaning roller, printing roller, web conveyance roller, coating backing roller, and calendar roller.

8. A system in accordance with claim 1 further comprising a backing roller mounted on said frame in nipped relationship with said contact cleaning roller, the substrate being a web and passing therebetween.

9. A system in accordance with claim 1 wherein said system is a first system, further comprising a second system substantially identical with said first system disposed for cleaning a second surface of said substrate opposite said first surface.

10. A method for continuously cleaning a substrate surface moving in a first direction by rolling contact with a surface of a contact cleaning roller whilst simultaneously and continuously renewing the surface of the contact cleaning roller, the substrate width being defined by a distance transverse to the first direction between first and second parallel edges of said surface, comprising the steps of:

a) providing a contact cleaning roller at least twice as long as said width of said substrate;

b) engaging said contact cleaning roller surface in rolling contact with said moving substrate surface to clean said substrate surface;

c) providing first and second renewal stations adjacent and outboard of said first and second edges, respectively, of the substrate;

d) engaging at least one of said renewal stations in renewal contact with said contact cleaning roller;

e) axially oscillating said contact cleaning roller transversely of said substrate surface during said rolling contact therewith by an oscillatory distance sufficient that at least one half of said contact cleaning roller surface is renewed by each one of said renewal stations during one complete cycle of said oscillation.

* * * * *